US006044777A

United States Patent [19]

Walsh

[11] Patent Number: 6,044,777

[45] Date of Patent: Apr. 4, 2000

[54] COMPOSITE METAL SAFE AND METHOD OF MAKING

[76] Inventor: Michael J. Walsh, 5724 Aluffo Rd., Paso Robles, Calif. 93446

[21] Appl. No.: 09/019,898

[22] Filed: Feb. 9, 1998

[51] Int. Cl.[7] ..... E04B 2/02

[52] U.S. Cl. ..... 109/83; 109/84; 312/406

[58] Field of Search ..... 109/76, 78–85; 312/406, 406.2, 400; 52/742.11, 265, 267–269

[56] References Cited

U.S. PATENT DOCUMENTS

| | | | |
|---|---|---|---|
| 139,414 | 5/1873 | Mulford | 109/83 X |
| 470,017 | 3/1892 | Simmons | 109/82 |
| 488,803 | 12/1892 | Yale | 109/83 |
| 648,036 | 4/1900 | Lanser | 109/84 |
| 792,030 | 6/1905 | Harris | 109/79 |
| 907,710 | 12/1908 | Aebi | 109/82 |
| 1,525,203 | 2/1925 | Schmitz | 109/83 |
| 1,547,720 | 7/1925 | Bellamore | 109/84 X |
| 1,666,486 | 4/1928 | Brainard et al. | 109/83 |
| 1,712,000 | 5/1929 | Gialdini | 109/83 |
| 1,873,246 | 8/1932 | Abbott | 109/83 |
| 1,904,912 | 4/1933 | Walters | 109/82 |
| 1,937,931 | 12/1933 | Walters | 109/84 |
| 2,232,004 | 2/1941 | Hunter | 109/82 |
| 2,750,902 | 6/1956 | McClellan | 109/82 |
| 3,095,838 | 7/1963 | Paulos et al. | 109/85 |
| 3,500,773 | 3/1970 | Pfaff et al. | 109/81 |
| 3,645,216 | 2/1972 | Radford et al. | 109/82 |
| 4,422,386 | 12/1983 | Carpenter | 109/84 X |

FOREIGN PATENT DOCUMENTS

| | | | |
|---|---|---|---|
| 1317984 | 1/1963 | France | 109/83 |
| 341015 | 9/1921 | Germany | 109/84 |
| 395253 | 5/1924 | Germany | 109/83 |
| 147327 | 7/1920 | United Kingdom | 109/85 |

*Primary Examiner*—Lloyd A. Gall
*Attorney, Agent, or Firm*—John J. Murphey

[57] ABSTRACT

A composite metal safe including separate inner and outer metal safe containers joined together in spaced-apart concentricity to form an endless pocket therebetween and wherein the inner container forms a hollow interior accessible through a front opening in both containers covered by a lockable safe door, a plurality of pocket stiffeners rigidly mounted between the outer and inner safe containers on all sides thereof and having apertures formed therethrough to allow passage of hardenable stiffening compound throughout the endless pocket that is charged between the containers to form an impenetrable barrier therebetween; mechanical interlocks for mechanically attaching and locking a top plate to the outer container to form a top cover to the safe and become fixedly mounted thereon by interaction with the hardened compound and, a spring-loaded connector for mechanically attaching and locking a bottom plate to the outer container to form a bottom cover to the safe and become fixedly mounted thereon by interaction with the hardened compound.

5 Claims, 11 Drawing Sheets

COMPOSITE METAL SAFE AND METHOD OF MAKING

BACKGROUND OF THE INVENTION

1. Field of the Invention

This invention pertains to the field of safes. More particularly, it pertains to the field of large and small safes that are made of inner and outer safe containers maintained in spaced-apart concentricity by the use of a curable compound inserted between the containers that hardens to become a very formidable barrier. This invention pertains to a special type of safe and method of making it where the problem of distortion, caused by welding together parts of the containers, and deformation caused by the exothermic reaction of the curable compound, are eliminated.

2. Description of the Prior Art

Safes have been around for hundreds of years. The propensity of humans to steal what does not belong to them has been recognized in every part of the world and containers made safe against such theft have been a part of our society since the early days of civilization.

There are many different types and designs of manufactured safes. The particular safe with which this invention is involved comprises an inner box or container made of metal housed inside an outer box or container of metal wherein the space between the boxes is filled with a curable material having the consistency and strength of concrete. The general structure of safes of this type involves the inner metal box located inside an outer metal box that is accessible through a front opening covered by a lockable safe door.

During construction, an opening is formed in the outer metal box through which the concrete-like material is charged in between the boxes and allowed to cure. A plate or cover is then welded over the opening to complete the structure. A standard safe door, containing a moveable handle, a combination or other type of lockable mechanism, and moveable locking rods is hung by hinges over the opening into the interior of the two containers.

The two-container safes of the prior art are generally joined together in concentric alignment by metal strips located in the space between the walls and are welded to each container and then welded together. The containers are then subject to working to straighten out the warpage that is commonly encountered with welded materials. A common problem encountered in the manufacture of these "two-box" safes is that the containers and other accessories warp and become disfigured when subject to heat from the welding operation. Further, when the concrete-like material, filled in the space between the containers, begins to cure, the exotherm or heat generated in the chemical reaction also causes warpage in the metal against which the material is contacted.

It is well-known that heating one particular place on a complex metal configuration causes local warpage of the metal to the point that the whole structure may be pulled out of shape. When this occurs, it requires remedial work, i.e., heating and bending the metal parts back into alignment. With safes, such remedial work is necessary so the heavy safe door operates properly (opens and closes easily) and that the overall design retains its aesthetic appearance with 90° corners and parallel sides. This extra work to straighten and realign the inner and outer containers constitutes a cost of manufacture that not only raises the price of this kind of safe but also slows the manufacturing process of safes and delays them in getting to the buyer.

The material charged into the empty space between the inner and outer boxes undergoes an exothermic reaction during curing. The heat from this reaction often is so great as to further warp the already warped parts of the safe.

SUMMARY OF THE INVENTION

This invention is a unique composite safe that undergoes far less warpage during manufacture and is, nevertheless, as strong and durable as safes made under the prior art processes described above. The invention provides for decreased manufacture time because some of the parts are mechanically joined together instead of being welded together. This is made possible by using the curable material in between the containers as the main anchoring medium for some of the outside parts and by using a method of manufacture that is unique unto itself as well as producing superior construction in less time than taken in the prior art.

The invention is a composite metal safe comprising separate inner and outer metal safe containers joined together in spaced-apart concentricity to form an endless pocket therebetween and wherein the inner container forms a hollow interior accessible through a front opening in both containers covered by a lockable safe door. A plurality of pocket stiffeners and inner locks are mounted to the outer and inner safe container walls, on all sides thereof, and have apertures formed therethrough to allow passage of the hardenable stiffening compound throughout the pocket that is charged between the containers to form an impenetrable barrier therebetween. Means are provided for mechanically attaching and locking a top and a bottom plate to the outer container to form respectively a top cover and a bottom cover to the safe and become fixedly mounted thereon by interaction with the hardened compound.

The inner metal container is preferably made from a one-piece U-shaped panel that forms the sides and rear walls of the safe with separate top and bottom covers welded thereto about their respective contacting marginal edges. The outer container is preferably made from a larger one-piece U-shaped panel that forms the sides and rear walls of the safe, however the top and bottom panels may or may not be welded thereto.

The novel approach of this invention is to place a plurality of endless pocket stiffeners and inner locks between the inner container and the outer container for contact with the respective inner and outer surfaces of each. These stiffeners have connectable elements, such as flat edges formed along the outer free edges thereof, adapted to mate with other connectable elements, such as biased wings extending from fittings located on the inside surface of the side, top and bottom walls of both containers, and other mechanical locks that work in concert with the hardenable material to provide full anchorage of the top and bottom covers to the outside of the safe.

Therefore, the outer container is mechanically fastened to the safe and small tack welds are made to retain it in position. However, because it is not fully welded to the inner container, the problem of warpage due to continuous and excessive welding is greatly reduced and, in some cases, eliminated.

Accordingly, the main object of this invention is a composite metal safe of new design and manufacture that is free of most of the problems of warpage due to welding. Other objects include a safe that utilizes the hardenable material located in the endless pocket formed between the inner and outer metal safe containers to make a cohesive structure including inner and outer containers; a safe that need not require the expensive and time-consuming step of realigning and reforming heat-distorted parts into an accurate structure with parallel sides, top and bottom and a doorway that freely allows swinging of a safe door therewith; a safe that is faster to construct with less technical manpower used to form welds and to straighten warped parts; a safe that is less expensive to build and faster to construct so as to be available to the consuming public at a lower price and in higher quantity; and, a safe that can be assembled by personnel of lesser skill than presently required to further lower the cost to produce the item.

These and other objects of the invention may be determined by reading the description of the preferred embodiments along with the drawings attached hereto. The scope of protection sought by the inventor may be gleaned from a fair reading of the claims that conclude this specification.

DESCRIPTION OF THE PREFERRED EMBODIMENTS

Figure 1:
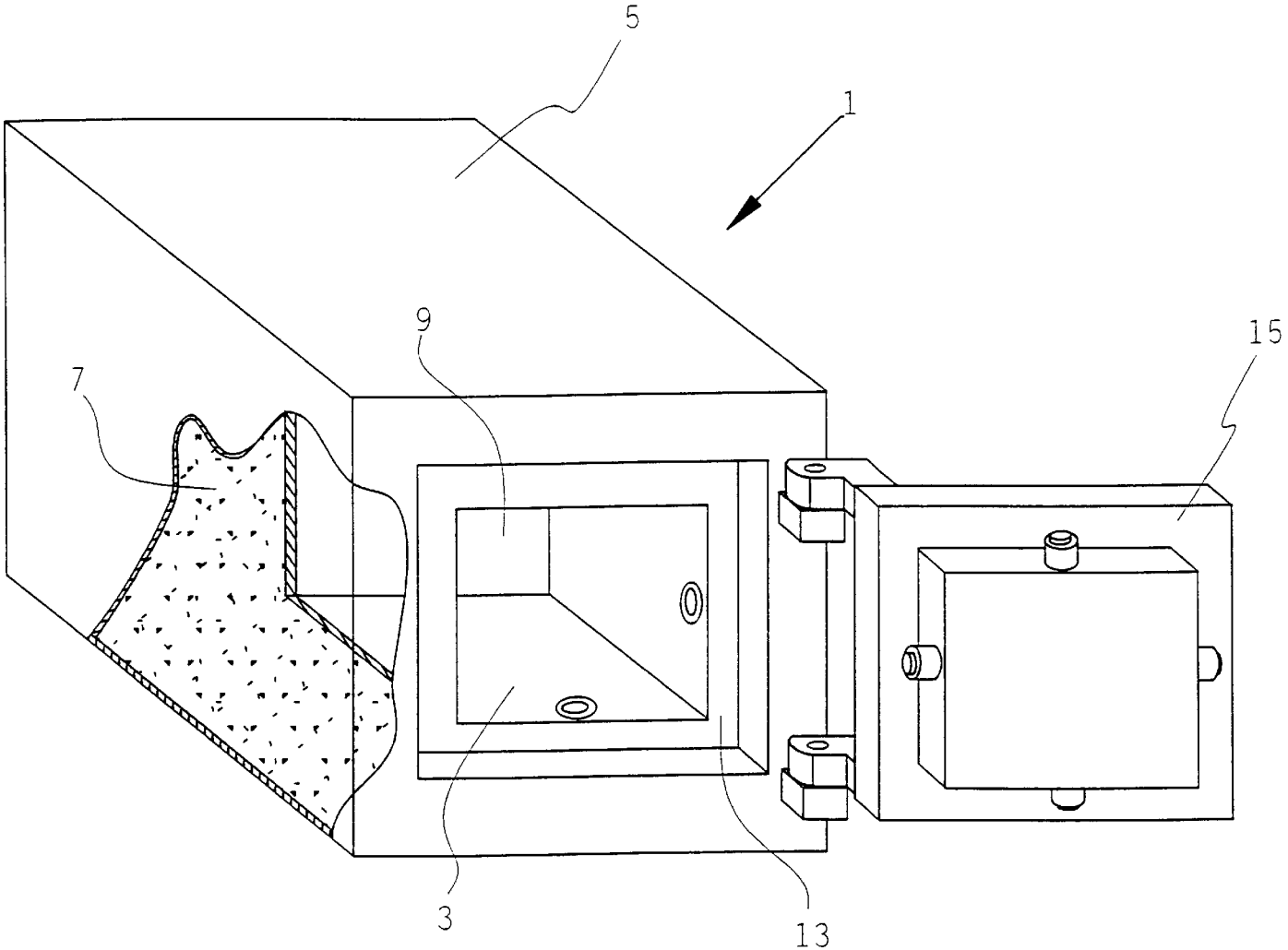
FIG. 1 is a front perspective view of the preferred embodiment of this invention.

Turning now to the drawings where elements are identified by numerals and like elements are identified by like numerals throughout the 28 figures, FIG. 1 shows the overall safe 1 of this invention and shows it to comprise an inner metal safe container 3 located inside an outer metal safe container 5 joined together (as will hereinafter be more full explained) in spaced-apart concentricity, i.e., containers 3 and 5 are arranged so that the walls making up inner container 3 are equidistant, as much as possible, from outer container 5, so as to form an endless pocket 7 therebetween. Inner container 3 forms a hollow interior 9 therein that is accessible through a front opening 13 in both containers covered over by a lockable safe door 15 as shown.

Figure 2:
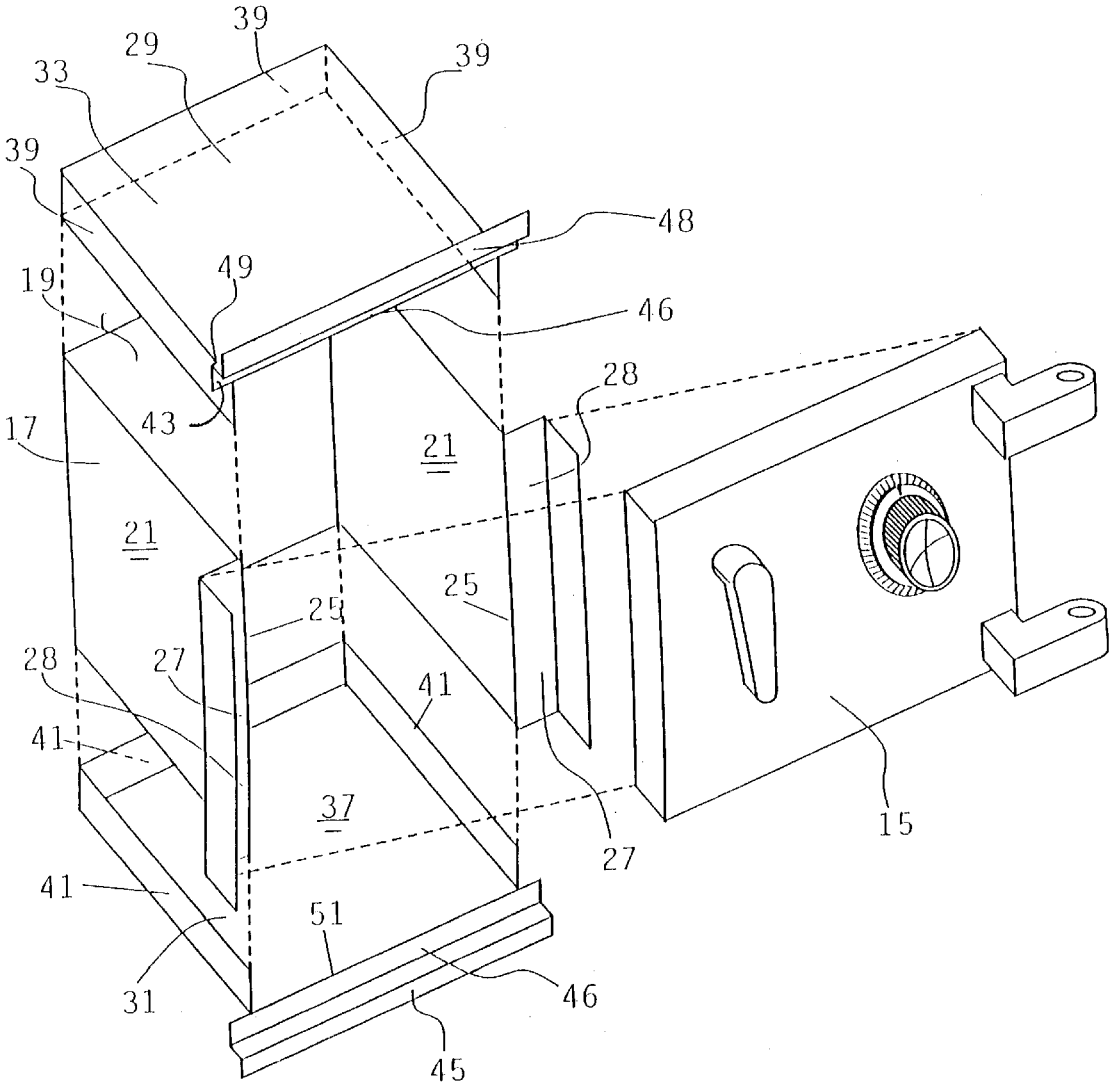
FIG. 2 is a blown-up view of the various elements that make up the inner container of this invention.

FIG. 2 shows the elements making up inner metal safe container 3 to include a U-shaped element 17 comprising a rear wall 19 and two contiguous side walls 21, said side walls arranged for spaced-apart location and attached to rear wall 19 along side edges as shown. The forward edges 25 of side walls 21 are formed into offsets 27 that include abutments 28 to accommodate safe door 15 and other elements as later described herein.

Also shown in FIG. 2 are an inner metal container top cover 29 and an inner metal container bottom cover 31. Both covers 29 and 31 comprise flat cover plates 33 and 37, respectively, each surrounded on three sides by upstanding short side walls 39 and 41 respectively, and each having an offset 43 and 45 at their front edges 49 and 51. Said offsets include abutements 46 to accommodate safe door 15. During construction, top cover 29 and bottom cover 31 are moved into position against the marginal edges of U-shaped element 17 and then welded thereto along the contacting edges by known welding technique.

Figure 3:
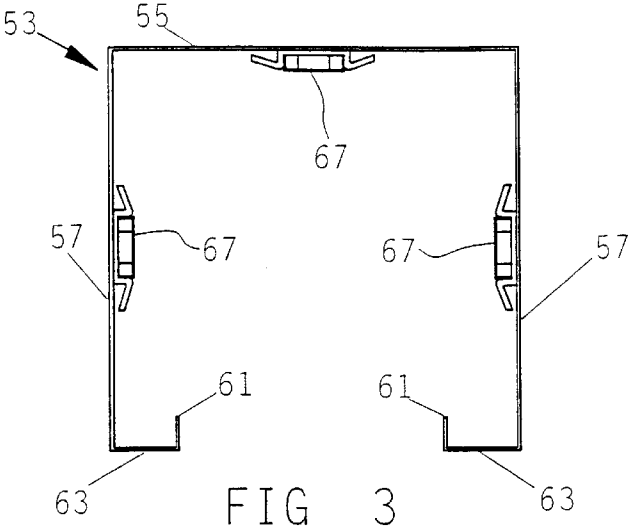
FIG. 3 is a top plan view of the U-shaped element that makes up the outer container of this invention.
Figure 4:
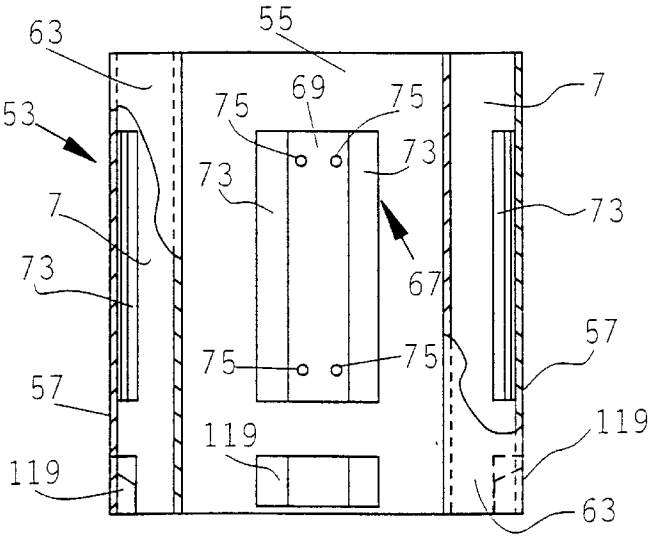
FIG. 4 is a side view of the embodiment shown in FIG. 3.

An outer container U-shaped element 53 is provided, as shown in FIGS. 3 and 4, comprising a rear wall 55 and two contiguous side walls 57, said side walls arranged for spaced-apart location on both sides of rear wall 55. The forward edges 61 of side walls 57 are formed into inwardly directed hooks 63 that compliment the edging surrounding safe door 15.

Before joining outer container 5 to inner container 3, endless pocket 7 must be modified to provide for the ease in assembly of the balance of the safe elements that is the hallmark of novelty of this invention.

Figure 5:
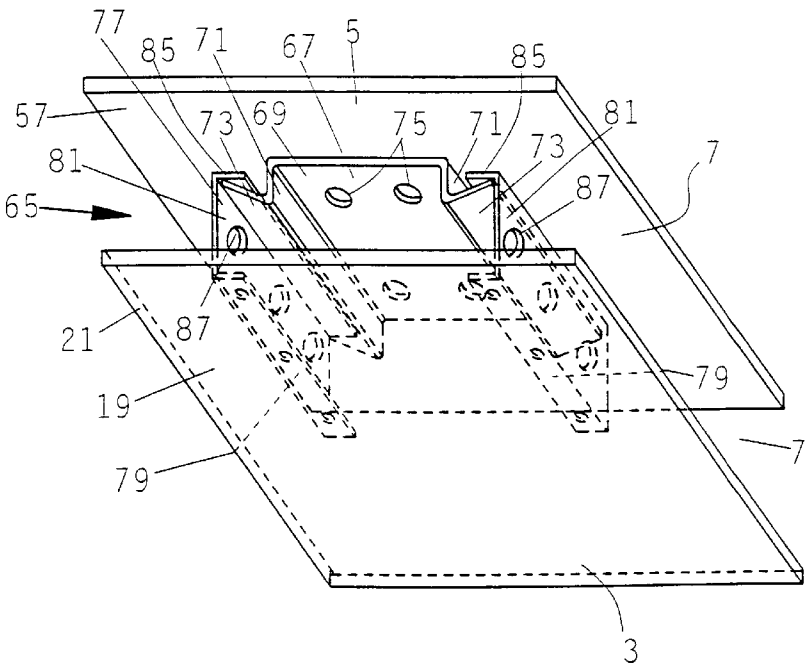
FIG. 5 is a perspective view of the side interlocks added to the outside of the fully assembled inner container of this invention.

Inner lock parts are provided for rigid mounting between inner and outer safe containers 3 and 5 on all sides thereof. As shown in FIG. 5, side interlocks 65 are mounted on the bottom, sides and rear (not shown) surfaces of both inner and outer containers 3 and 5. Interlocks 65 are shown to comprise a first element 67 including a stiff, flat, elongated planar center section 69 for mounting flat against the inside surface of outer container side walls 57 and rear wall 55. The elongated side edges of center section 69 are bounded by a pair of spaced-apart short upstanding side walls 71, preferably at right angles or normal to the plane of section 69. A pair of wing-shaped members 73 extend outward from the upper terminal edges of side walls 71 and are arranged to slope or slant backward toward the plane of center section 69 as shown in FIG. 5. A plurality of apertures 75 are formed in center section 67 for fastening (welding) section 69 to the inside surface of outer container side and rear walls 57 and 55, respectively.

Interlocks 65 are also shown in FIG. 5 to comprise a pair of second "C"-shaped elements 77 including an elongated base strip 79 for mounting flat against the inside surface of inside side walls 21 and rear wall 19. One side edge of base strip 79 is bounded by an upstanding wall 81, preferably at right angles or normal to the plane of base strip 79. A flat strip 85 is formed along the top edge of wall 81 and extends inward in spaced-apart arrangement with and parallel to base strip 79 as shown. The purpose of flat strip 85 is, that when elements 77 are faced toward each other, to slide under wing-shaped members 73 to lock first and second elements 67 and 77 together. In fact, the appropriate assembly technique is to slide outer U-shaped element 53 down over inner U-shaped element 17 to interlock said outer container 5 and inner container 3 together in geometric concentricity and, simultaneously, form endless pocket 7 therebetween.

As further shown in FIG. 5, center section 67 has formed therethrough a plurality of apertures 87 for the purpose of allowing the curable or hardenable material to pass therethrough in the uncured state and to take shape on both sides of the elements and on the inside and outside of side interlocks 65 and later form an impenetrable barrier thereabout.

As shown in FIGS. 6 through 9, a shortened first element 89 (FIG. 7), comprising a short center strip 91, is provided for mounting flat against the inside surface of an outer container top cover 93 (FIG. 8), and where the side edges of center strip 91 are bounded by a pair of spaced-apart short upstanding side walls 97, preferably at right angles or normal to the plane of strip 91, and a pair of wing-shaped members 99 extend outward from the upper terminal edge of side walls 97 and are arranged to slope or slant backward toward the plane of center strip 91. A plurality of apertures 101 are formed in center section 91 for fastening (welding) section 91 to the inside surface of outer container top cover 93.

Figure 6:
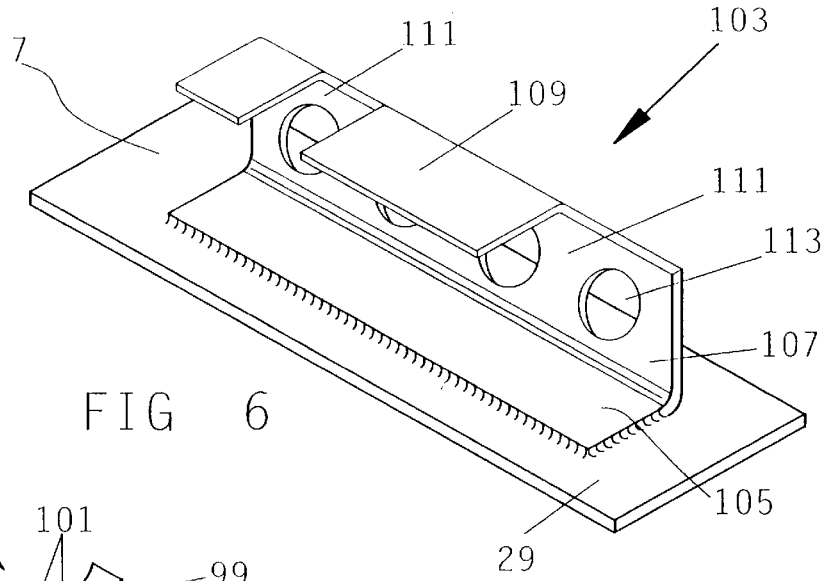
FIG. 6 is a perspective view of the modified second element of this invention.
Figure 7:
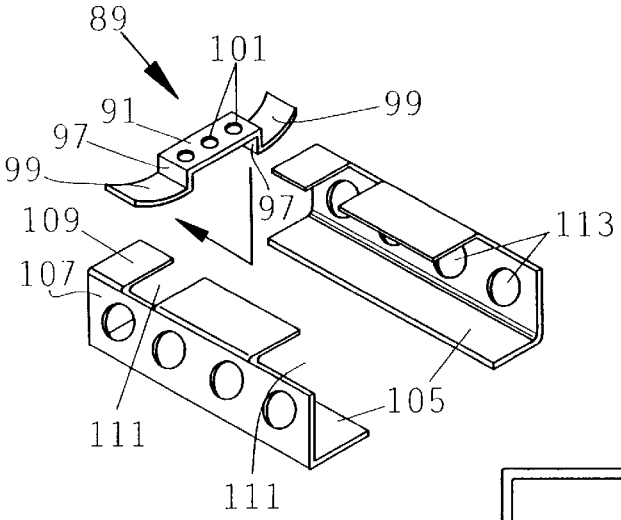
FIG. 7 is a close-up perspective view of the shortened first element that connects to the second element shown in FIG. 6.
Figure 8:
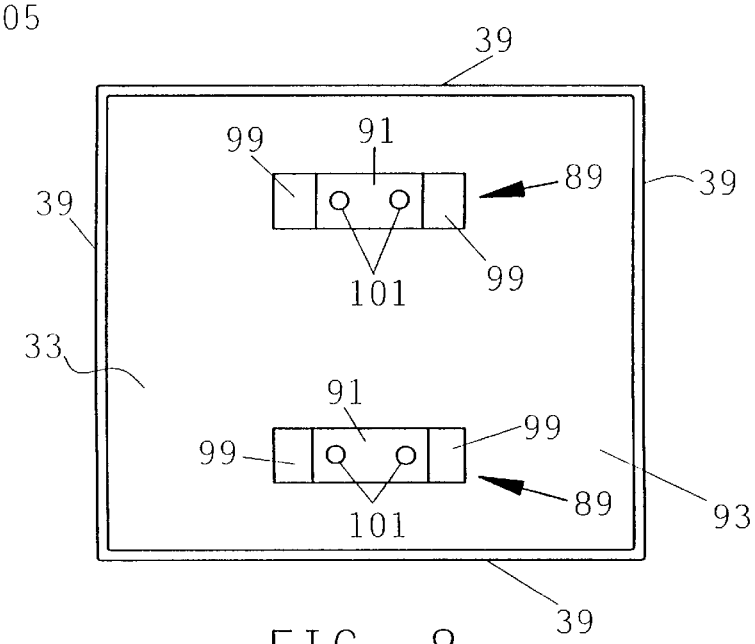
FIG. 8 is a bottom view of the outer container top cover and to the shortened first element attached thereto.
Figure 9:
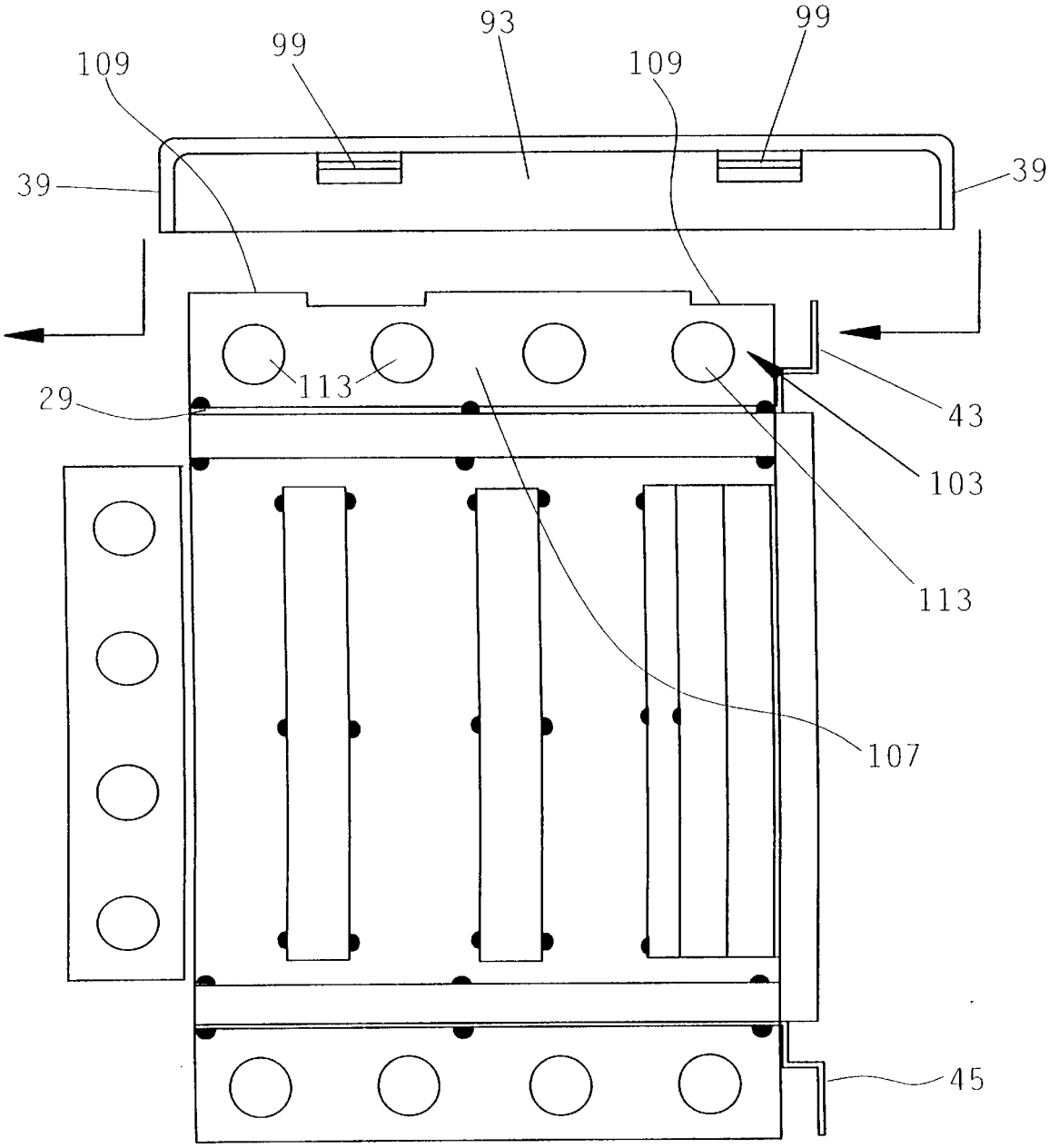
FIG. 9 is a side view of the inner container of the safe of this invention with all of the side interlocks in position and the outer container top cover in position to be placed down on the top of the safe before being slid sideways into position on the top of the safe.

A modified second element 103 is shown in FIG. 6 to comprise an elongated base strip 105 for mounting flat against the outside surface of inner container top surface 29. One side edge of base strip 105 is bounded by an upstanding wall 107, preferably at right angles or normal to the plane of base strip 105. A flat, segmented strip 109 is formed along the top of wall 107, with staggered openings 111, and extends inward in spaced-apart arrangement with and parallel to base strip 105 as shown. The purpose of segmented flat strip 109 is to accept passage through open segments 111 of wing-shaped members 99 when outer top cover 93 is set down, in an offset manner as shown in FIG. 9, and then moved or slid sideways so that top cover 93 is centered over outer container 53 and so that wing-shaped members 99 slide under strip 109 of inwardly facing "C"-shaped elements 103 to lock top cover 93 in geometric concentricity with inner container top cover 29, as shown by the arrows in FIG. 9. A plurality of apertures 113 are formed in wall 107 for the purpose of allowing the curable or hardenable material to pass therethrough, in the uncured state, and to take shape on both sides of the elements and on the inside and outside of side interlocks 65 and later form an impenetrable barrier thereabout.

Figure 18:
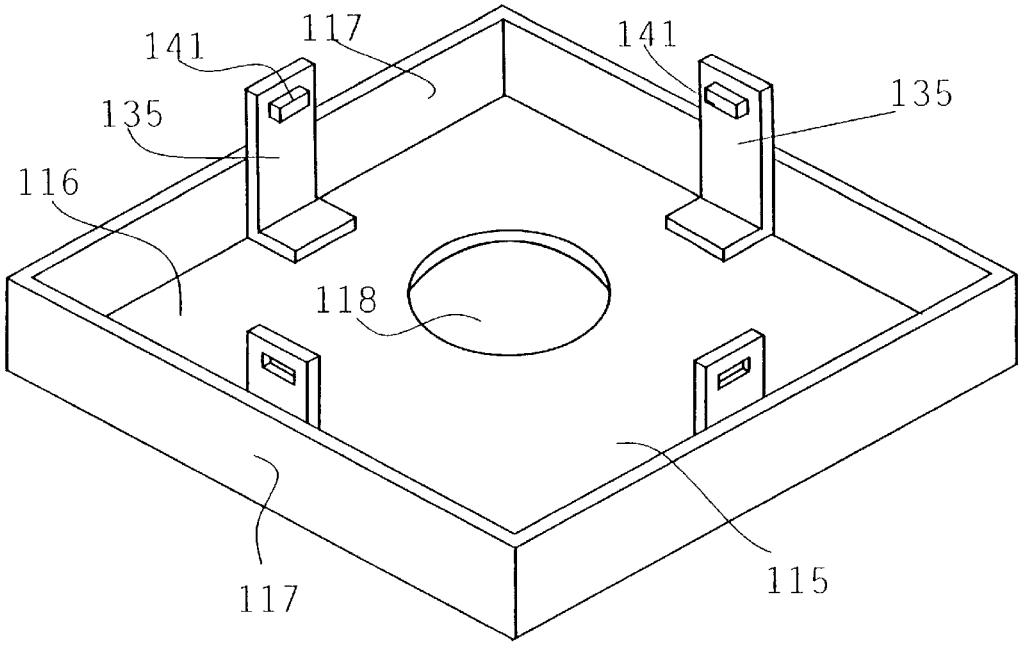
FIG. 18 is a perspective view of the inside of the bottom cover of the safe showing the L-shaped clips in position and the location of the opening in the cover for insertion of the curable compound.

Safe 1 is covered at the bottom by a metal cover 115 that is shown in FIG. 18 as comprising a quadrangular flat plate 116 bounded by short, upstanding walls 117 surrounding the outer perimeter thereof and having an opening 118 formed therethrough.

Figure 10:
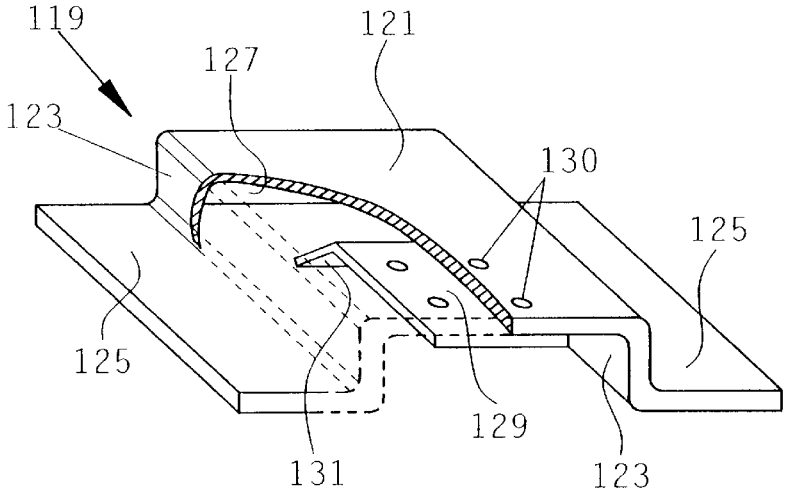
FIG. 10 is a perspective view of the spring-loaded inner lock bodies of this invention.
Figure 14:
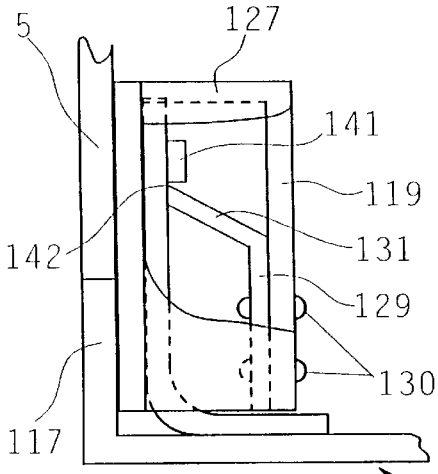
FIG. 14 is a side view of a inner lock body assembled with the L-shaped bracket such as when the bottom safe cover is fully installed on the safe.
Figure 11:
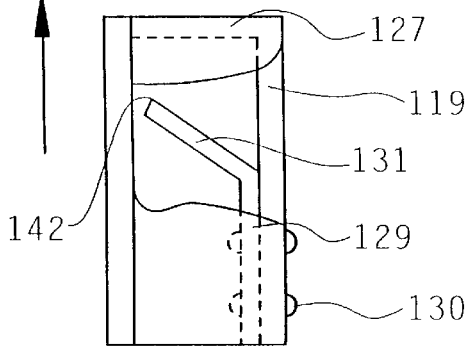
FIG. 11 is a side view of the embodiment shown in FIG. 10.
Figure 12:
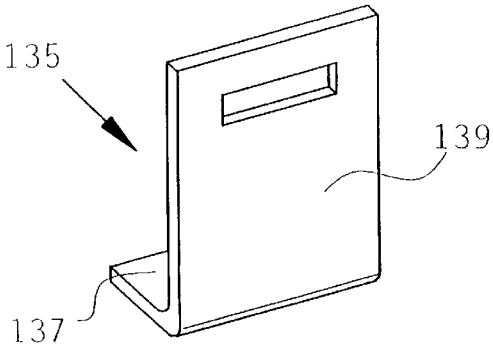
FIG. 12 is a perspective view of the L-shaped bracket that is inserted in the lock body of FIG. 10.
Figure 13:
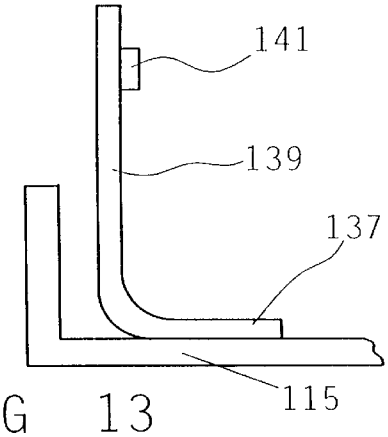
FIG. 13 is a side view of the L-shaped bracket and a portion of the bottom safe cover to which it is attached.

A spring-loaded inner lock body 119 is shown in FIG. 10 that is attached as by welding to rear wall 55 as shown in FIG. 4 for the purpose of attaching bottom cover 115 to outer container 5. As shown in FIG. 10, lock body 119 is comprised of a central plate 121 having a pair of spaced-apart side walls 123 depending in the same direction from the side edges of plate 121 and preferably normal thereto. Side walls 123 terminate along their bottom edges in a pair of outwardly-facing wing plates 125 arranged on a common plane for attachment, such as by welding, to inner surface of bottom cover 115. End plate 127 covers over one end of lock body 119 as shown. A spring plate 129 is attached as by rivets 130 as shown in FIGS. 10 and 11 to the inside surface of central plate 121 and has a bend placed therein that forms a leg 131 that is bent at an angle as shown. An L-shaped clip 135 is formed, as shown in FIG. 12, and contains a short leg 137, a long leg 139, extending from one terminal edge and normal thereto, and an out-dent 141 as shown in FIGS. 12–14. Short leg 137 is welded to the inside of bottom cover 115 as shown in FIG. 14. Out-dent 141 is arranged to intersect the edge 142 of spring plate leg 131 when clip 135 is inserted underneath central plate 121 and to seat on the far side of leg 131 when bottom cover 115 is placed over the bottom of outer container 5 and driven sharply home to insert long clip legs 139 underneath lock body central plate 121 on four sides of said outer container. End plate 127 is used to prevent the influx of curable material under central plate 121.

Figure 16:
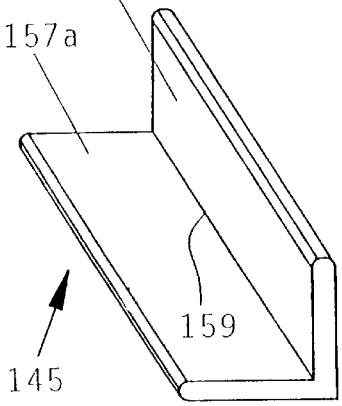
FIG. 16 is a perspective view of the anti-drill bar of this invention.
Figure 17:
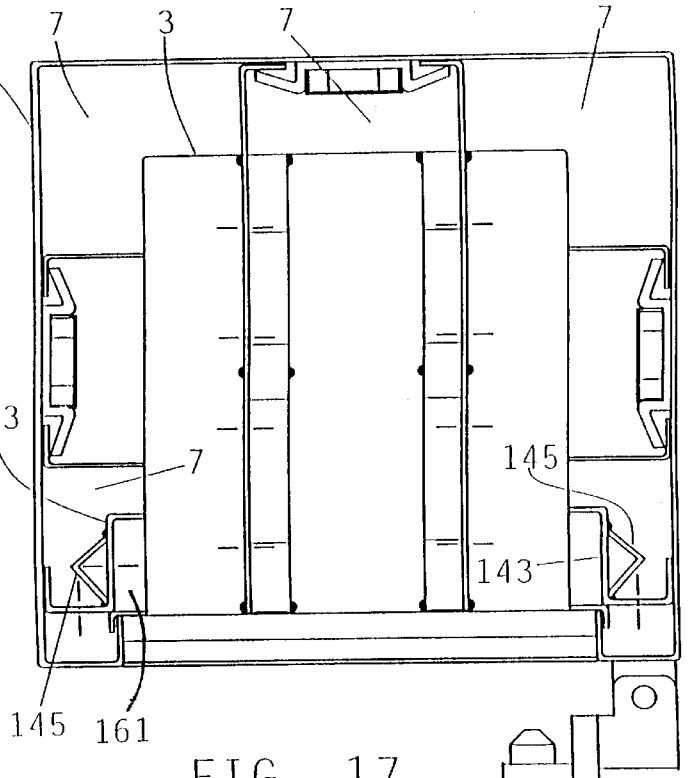
FIG. 17 is a top plan view, partly in section, of the top of the safe without the top cover showing the position of the pocket stiffener and anti-drill bar in position about the safe door frame.
Figure 15:
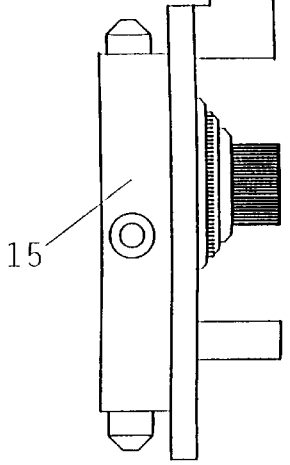
FIG. 15 is a perspective view of the pocket stiffener of this invention.
Figure 15:
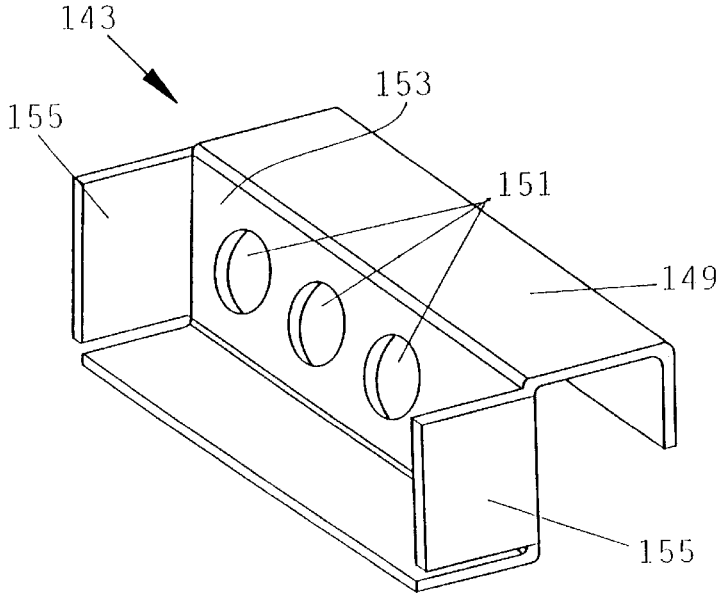

In the area surrounding the safe door opening between inner and outer safe containers are placed a pocket stiffener 143 and an anti-drill bar 145 as shown in FIGS. 15 through 17. Pocket stiffener 143 is shown in FIG. 15 to comprise an S-shaped plate 149 having a plurality of openings 151 formed in the central body 153 thereof for allowing uncured compound to pass therethrough to fill the area immediately adjacent thereto. A pair of spaced-apart cover plates 155 are extended from central body 153 to confine the flow of uncured compound therebetween.

Anti-drill bar 145 is shown in FIG. 16 to comprise a pair of elongated plates 157*a* and 157*b* respectively joined along one common marginal edge 159 at a right angle to each other. As shown in FIG. 17, bar 145 is attached as by welding along one side of central body 153 to pocket stiffener 143 and the combination welded into place about door frame 161 so that the right angle of bar 145 is facing outward at a 45° angle to divert any attempted drilling into the safe in the area of door frame 161.

Figure 22:
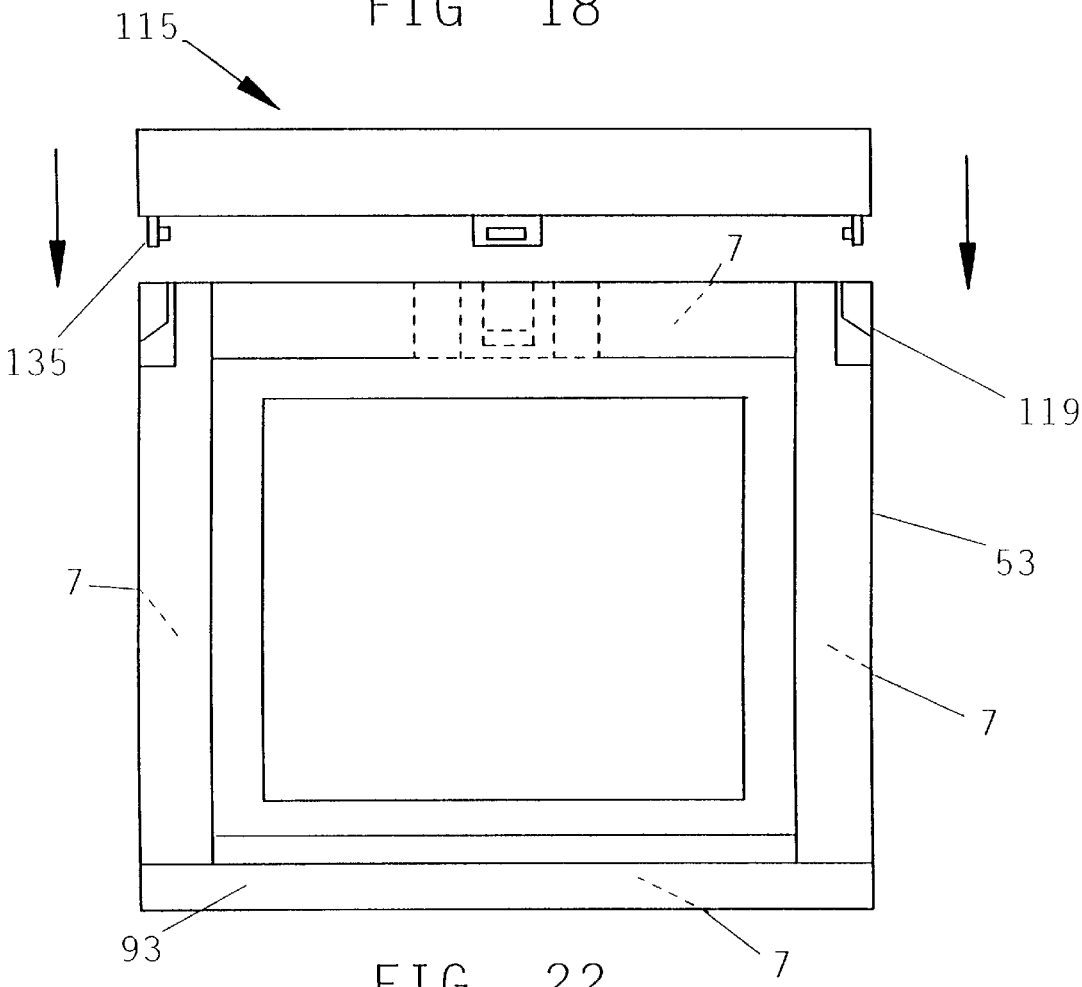
FIG. 22 is a side plan view of the embodiment shown in FIG. 21 after the U-shaped outer container already slid down over the outside of the unit and with the bottom cover in position over the bottom of the safe ready to be pressed downward into position thereon; with the bottom cover in position to be placed over the safe and pressed into position.
Figure 19:
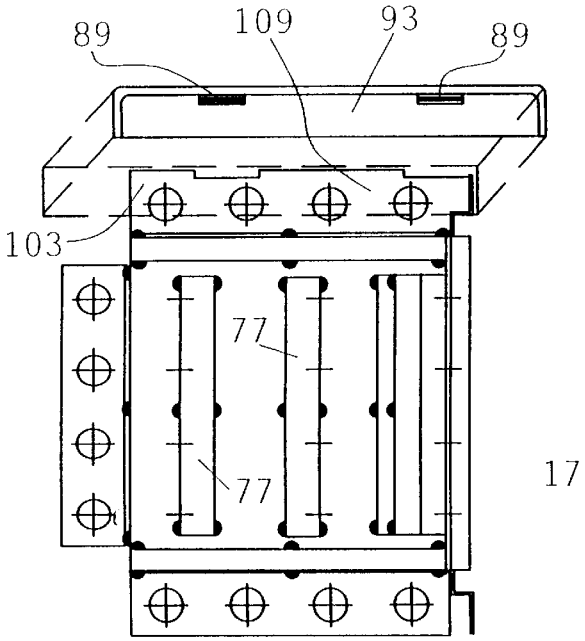
FIG. 19 is a side plan view of the safe showing how the top cover is applied over the safe, pushed downward and to the side into position over the top of the safe.
Figure 20:
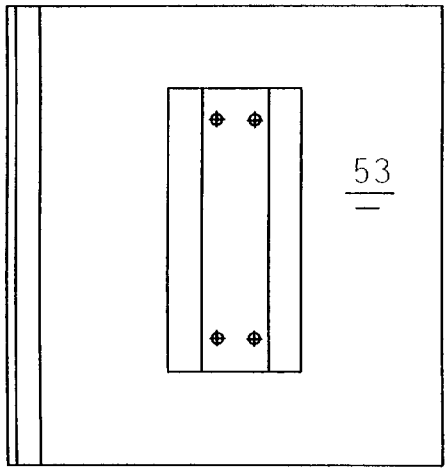
FIG. 20 is the same side plan view as that of FIG. 19 showing the top cover in final position on the safe.
Figure 20:
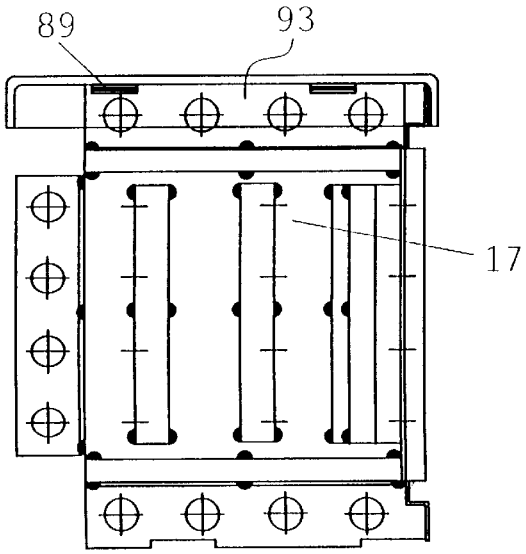
Figure 21:
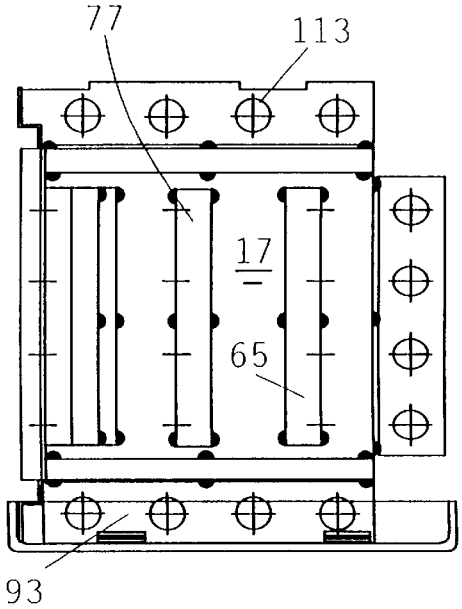
FIG. 21 is the same side view as that of FIG. 19 showing the safe up ended to place the top cover on the bottom and shows the U-shaped outer container ready to be slid down over the outside of the unit.

To assemble the safe of this invention, outer container top cover 93 is pressed down off center over the top of inner container top cover 29 and modified second elements 103, as shown in FIG. 19, and then moved sideways, as shown in dotted outline, to bring it central over inner container 17, as shown in FIG. 20. This sideways movement allows winged-shaped members 99 of shortened first element 89 to slide under flat segmented strip 109 and become locked in place. The entire unit is then upended to place outer container top cover 93 on the bottom, as shown in FIG. 21. Outer container U-shaped element 53 is then slid downward, in the direction of the arrows in FIG. 21, over the unit to engage side interlocks 65. FIG. 22 shows the upside down unit with outer container, U-shaped element 53 in place over outer container top cover 93.

In its upside down condition, a mixture of hardenable material is charged in through opening 118 in bottom cover 115 into the top of endless pocket 7 and subject to vibration, or other packing means known in the art, to force the air bubbles out and to cause the material to flow through apertures 87 and 113 to all areas of pocket 7. Once the material has filled in under outside container top cover 93 (which is temporarily at the bottom of safe 1) and all the sides, outside container bottom cover 115, is placed over safe 1 and firmly pressed downward over the material as shown in FIG. 22. Any excess material that exudes upward through opening 118 in bottom cover 115 is scraped away for removal. The hardened material, in cooperative engagement with top cover 93, holds cover 93 against sideways movement so that both wing-shaped members 99 and modified second elements 103 act to retain top cover 93 in place. Optionally, opening 118 is left uncovered at the bottom of up righted safe 1 to pass water therethrough that may accumulate in the hardened material by condensation.

As bottom cover 115 is pushed downward onto outer container 5, L-shaped clips 135 are guided into the space provided in spring-loaded inner lock body 119, under central plate 121. Upon full insertion, spring plate 129 snaps over out-dent 141 in clip 135 and locks cover 115 into mechanical engagement with outer container 5. Further connection may be made therebetween by welding either in spots or along the entire seam between cover 115 and outer container 53. Once bottom cover 115 is snapped into place then safe 1 is turned right side up and is fully assembled. As with top cover 93, the hardened material also aids in retaining bottom cover 115 intact in safe 1.

In this embodiment of the invention, one may choose to tack weld along the mating edges of top cover 93 and outer container 53 and/or along the mating edges of bottom cover 115 and outer container 53. However, once the curable compound undergoes curing and hardening, its stiffness plus the mechanical connections previously described are sufficient to hold the entire safe together.

Figure 23:
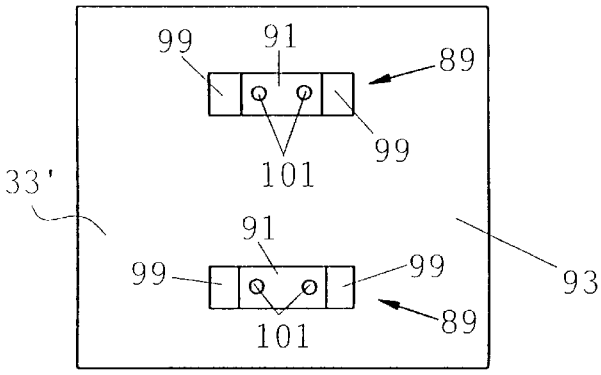
FIG. 23 is the same view as FIG. 8 except for the absence of side walls to the top cover.
Figure 24:
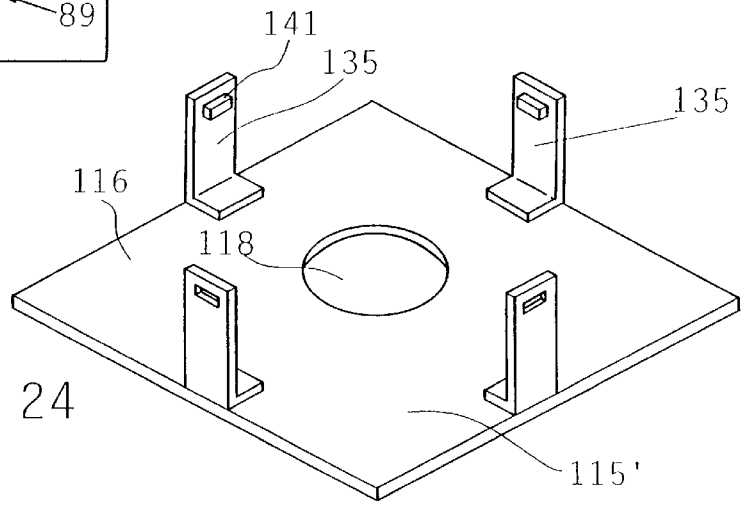
FIG. 24 is the same view as FIG. 18 except for the absence of side walls to the bottom cover.
Figure 28:
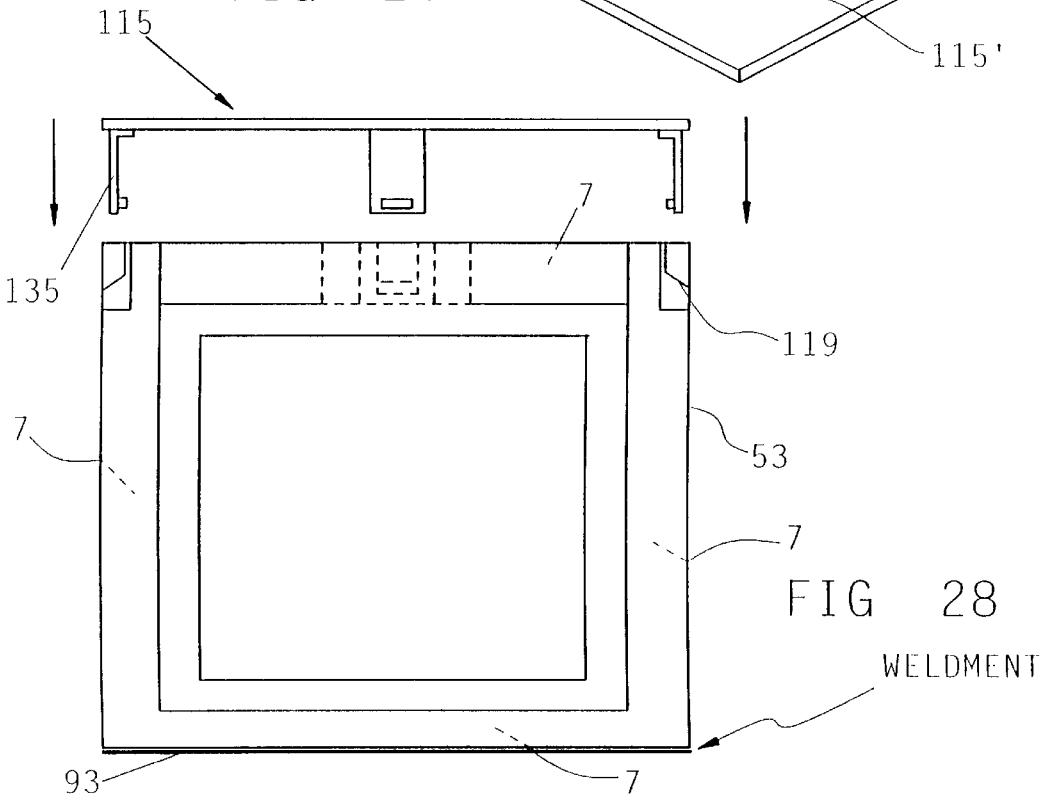
Figure 25:
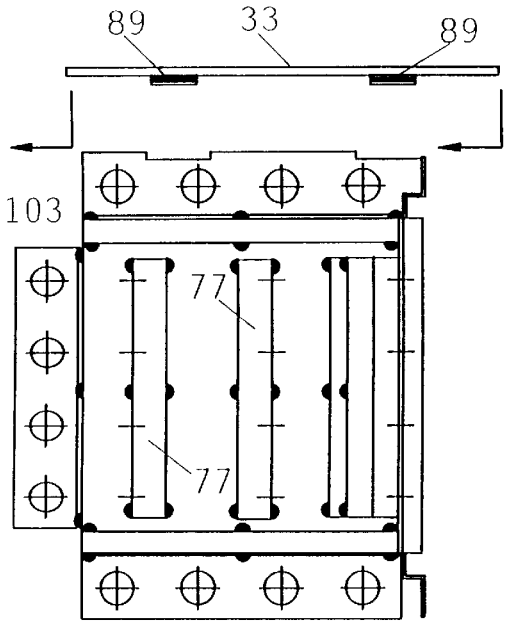
FIG. 25 is the same view as FIG. 22 and is another embodiment of this invention.
Figure 26:
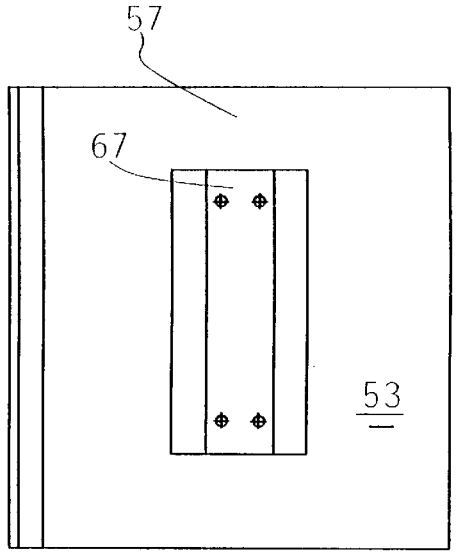
FIG. 26 is the same view as FIG. 19 and is part of the embodiment of FIG. 25.
Figure 26:
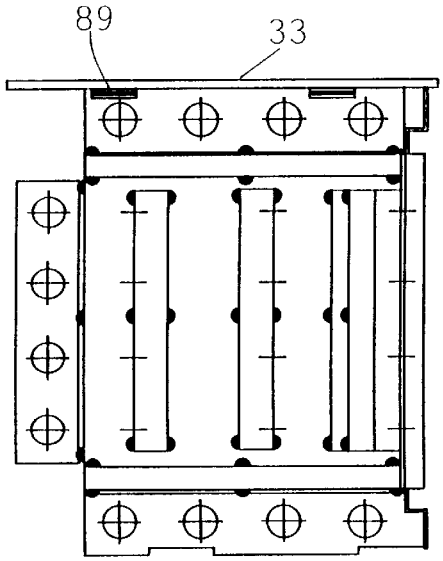
Figure 27:
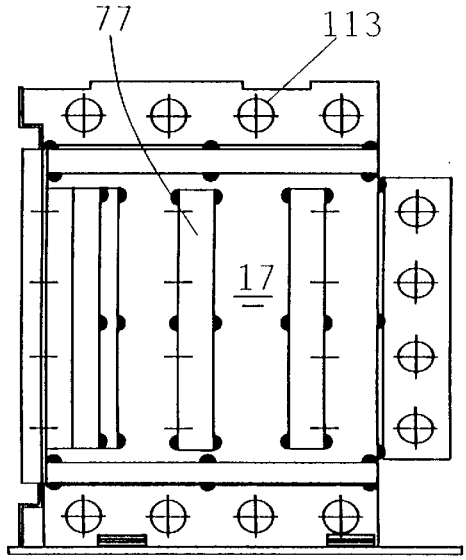
FIG. 27 is the same view as FIG. 20 and is part of the embodiment of FIG. 25; and, FIG. 28 is the same view as FIG. 21 and is part of the embodiment of FIG. 25.

In a second embodiment of this invention, shown in FIGS. 23 through 28, top cover side walls 39 and bottom cover side walls 115 are eliminated and the mating surfaces between the periphery of top plate 33 and outer container U-shaped element 53 and the periphery of bottom flat plate 116 and outer container U-shaped element 53 are welded into place. In this embodiment, FIG. 23 shows top cover 33' to be of the same construction as cover 33 except for the loss of side walls 39; FIG. 24 shows bottom cover 115' to be of the same construction as cover 115 except for the loss of side walls 117; and FIGS. 25 through 28 to be of the same general method of assembly except that top and bottom cover plates 33' and 115' are welded about their periphery in the final assembly.

In the method of making the composite safe of this invention, the following steps are required: First, inner and outer metal safe containers are provided, as shown in the drawings, both having a hollow interior accessible through a front opening. The containers are then joined together in spaced-apart concentricity to form an endless pocket therebetween. A plurality of rigid pocket stiffeners are provided in the endless pocket and attached to said inner container and arranged for mechanical fastening contact with said outer container. The outer container is then assembled about said pocket stiffeners and over said inner container to form a whole container. A charge of hardenable material is fed into said endless pocket to fill it and form, along with said inner and said outer container, an impenetrable barrier to the interior of said safe.

The step of providing an inner metal safe container, having a hollow interior accessible through a front opening, includes the step of providing an inner U-shaped element and separate top and bottom metal plate all welded along their contacting marginal edges. The step of providing an outer metal safe container, having a hollow interior accessible through a front opening, includes the step of providing an outer container U-shaped element and separate top cover plate and bottom cover plate. The step of joining said inner and outer containers together in spaced-apart concentricity to form an endless pocket therebetween includes the step of establishing the pocket therebetween having a constant thickness along the sides, the rear, the top and the bottom of the safe.

The step of providing a plurality of rigid pocket stiffeners in said endless pocket attached to said inner container and arranged for mechanical fastening contact with said outer container, includes the steps of making them of metal strap, each stiffener having a major planar area, said planar areas arranged normal to the sides of said safe. The step of providing a plurality of rigid pocket stiffeners can also include providing a plurality of C-shaped pocket stiffeners, each stiffener having a flat bottom edge strip welded to said inner top, an upstanding major planar center section, and an interrupted flat top edge strip passing parallel to said bottom edge strip and, a narrow lock fixture attached to the underside of said top cover including a center portion attached to said top cover and a pair of wings offset slightly below said center portion and extending therefrom outwardly and upwardly toward said top cover, said wings adapted to be moved under said interrupted flat top rail when said top cover is temporary placed down on said stiffeners in an offset position and then slid sideways to engage said wings under said top rail. This step may be augmented by the step of forming apertures through the pocket stiffeners for passage therethrough of said hardenable material during its movement through the endless pocket before it hardens.

The step of providing a plurality of rigid pocket stiffeners in said endless pocket attached to said inner container and arranged for mechanical fastening contact with said outer container, may be followed by the additional step of providing an anti-drilling means in said endless pocket. This step would include making or providing anti-drilling means of the type where the drilling means comprises two strips of hard metal set at right angles to each other and interconnected to form a right angle channel and said channel is mounted at a non-vertical and non-horizontal angle between said inner and outer metal safe containers about said front opening.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A composite metal sale comprising:

a) separate inner and outer metal safe containers, each said container including a rear wall, having inner and outer wall surfaces, opposed side walls, having inner and outer wall surfaces, a top plate and a bottom plate, each of said walls, top and bottom plates joined together in spaced-apart concentricity to form an endless pocket therebetween and wherein said safe inner container forms a hollow interior accessible through a front opening in both containers covered by a lockable safe door;

b) a plurality of inner lock parts to maintain said endless pocket at a constant width throughout, said inner lock parts comprising a first element for mounting to one of said safe container wall surfaces interior said pocket and inward from the comers of said inner and outer safe containers, said first element having a pair of wing-shaped members connected thereto and extending outward in spaced-apart arrangement from said first element, and a second element for mounting to another of said safe container wall surfaces interior said pocket having a pair of spaced-apart flat strips extending outward in spaced-apart arrangement from said second element, said wing-shaped members and said strips arranged to be slidingly engaged during assembly of said inner arid said outer container walls and to remain engaged following filling said endless pocket with a hardenable compound that forms an impenetrable barrier therein;

c) means for slidingly engaging said outer top plate to said outer container to form an outer top cover to the safe to become fixedly mounted thereon by interaction with said hardenable compound;

d) means for mechanically attaching and locking said outer bottom plate to said outer container to form a bottom cover to the safe; and, wherein said first element further comprises:

e) a stiff, flat, elongated planar center section for mounting flat against said inner wall surface of one of said container walls;

f) a pair of spaced-apart short side walls extending upward from said center section; and, g) wherein said wing-shaped members extend outward from said short side walls and are arranged to slope or slant backward to ward the plane of said center section.

2. The composite metal safe of claim 11 further including means for attaching said outer top plate to said safe, to close off said endless pocket from the top of said safe, and to allow said outer top plate to become fixed on the top of the safe by the cured compound including:

a) an inner top plate for welding about the top edges of said inner safe container;

b) a narrow lock fixture attached to the underside of said outer top plate, inward from the comers of said inner and outer safe containers, said fixture including a center portion for attachment to said top plate, a pair of spaced-apart side walls extending downward therefrom, and a pair of wing-shaped members extending outward from said side walls;

c) a C-shaped locking member comprising an elongated base strip for mounting flat against the outside surface of said inner top plate, d) a side wall extending upward therefrom along the length of said strip; and, e) a flat, segmented strip formed along the top of said side wall and extending outward therefrom, having a series of openings staggered therealong each of a width for receipt therethrough of said wing-shaped members following location of said outer top plate against the safe, to pass said wing-shaped members through said openings, and sliding said top plate to one side to slide said wing-shaped members under said strip to thereafter hold said outer top plate in geometric concentricity with said inner top plate.

3. The composite metal safe of claim 2 including at least two pairs of said C-shaped locking members, each said pair having their flat, segmented strips facing each other in spaced-apart relationship a distance to accept a single wing-shaped member therebetween.

4. A method of making a composite safe comprising the steps of:

a) providing an inner metal safe container, said container including a rear wall having inner and outer wall surfaces, opposed side walls having inner and outer wall surfaces, a front wall, a top plate, and a bottom plate joined together along their mating marginal edges wherein said inner container forms a hollow interior accessible through a front opening covered by a lockable said door;

b) providing an outer metal safe container, said container including a rear wall, opposed side walls, a front wall, and a top plate joined together along their mating marginal edges wherein said front wall has formed therein a front opening covered by said lockable safe door;

c) joining said containers together in spaced-apart concentricity to form an endless pocket therebetween;

d) providing a plurality of inner lock parts to maintain said endless pocket at a constant width throughout, said inner lock parts comprising a first element for mounting to one of said safe container wall surfaces interior said pocket and inward from the coolers of said inner and outer safe containers, said first element having a pair of wing-shaped members connected thereto and extending outward in spaced-apart arrangement from said first element, and a second element for mounting to another of said safe container wall surfaces interior said pocket and opposite said first element, having a pair of spaced-apart flat strips extending outward in spaced-apart arrangement from said second element, said wing-shaped members and said strips arranged to be slidingly engaged during assembly of said inner and said outer container walls and to remain engaged following filling said endless pocket with a hardenable compound that forms an impenetrable barrier therein;

e) upending said assembled containers, so that said outer top plate is on the bottom and said endless pocket is accessible through the bottom of the safe;

f) attaching an outer bottom plate having an opening formed therethrough, over said inner bottom plate so that said endless pocket surrounds all of the surfaces of the safe; and, g) charging a quantity of hardenable material into said opening in said outer bottom plate and filling said endless pocket therewith to form, when hardened, an impenetrable barrier to the interior of said safe.

5. A composite sate made according to the method of claim 4.

* * * * *